US005647519A

United States Patent [19]

Brennan

[11] Patent Number: 5,647,519

[45] Date of Patent: Jul. 15, 1997

[54] CRUTCH BEVERAGE HOLDER

[76] Inventor: Dennis Brennan, 9865 Country Park Ct., Roseville, Calif. 95661

[21] Appl. No.: 618,974

[22] Filed: Mar. 20, 1996

[51] Int. Cl.[6] ..... A45B 3/00

[52] U.S. Cl. ..... 224/407; 224/148.7; 248/311.2; 135/66; 135/68

[58] Field of Search ..... 224/407, 409, 224/148.7, 428, 434, 555, 557, 926; 135/66, 68; D3/229; D12/419, 420; 248/311.2; 62/457, 3, 457.4, 457.5, 457.7

[56] References Cited

U.S. PATENT DOCUMENTS

| | | | |
|---|---|---|---|
| 2,311,049 | 2/1943 | Hedden | 135/68 |
| 2,750,951 | 6/1956 | Barnwell | 135/68 |
| 2,904,299 | 9/1959 | Dalton | 248/311.2 |
| 2,912,991 | 11/1959 | Shinn | 135/66 |
| 3,391,891 | 7/1968 | Garden | 248/311.2 |
| 3,532,318 | 10/1970 | Lloyd | 248/311.2 |
| 3,985,148 | 10/1976 | Cadman | 135/66 |
| 4,146,045 | 3/1979 | Grant | 135/66 |
| 4,289,156 | 9/1981 | Ulics | 248/311.2 |
| 4,428,390 | 1/1984 | Baird | 135/66 |
| 4,819,843 | 4/1989 | Nakayama | 224/42.45 R |
| 5,101,845 | 4/1992 | Kravetz | 135/66 |
| 5,423,509 | 6/1995 | LaPorte et al. | 248/311.2 |

FOREIGN PATENT DOCUMENTS

| | | | |
|---|---|---|---|
| 500121 | 2/1954 | Canada | 224/407 |

*Primary Examiner*—Henry J. Recla
*Assistant Examiner*—Gregory M. Vidovich
*Attorney, Agent, or Firm*—Welsh & Katz, Ltd.

[57] ABSTRACT

A holder for a beverage container for use with a crutch having a pair of bowed sides connected by a bearing portion at their upper ends, a leg portion at their lower ends, a hand grip connected between the sides and a pair of aligned apertures therethrough on an axis generally parallel to the axis of the hand grip. The beverage holder, in combination with the beverage container, includes an abutting attachment member spanning the bowed sides parallel to the pair of aligned apertures and wrapping around and resiliently engaging the pair of apertures from opposing sides of the crutch. The beverage holder further includes a hoop extending from the attachment member in a horizontal plane defining a circular receptacle for the beverage container and a downwardly depending beverage container stop extending below the hoop for providing a positive stop for the supported beverage container within the hoop.

5 Claims, 2 Drawing Sheets

CRUTCH BEVERAGE HOLDER

FIELD OF THE INVENTION

The field of the invention relates to cup holders and, more particularly, to a beverage holder for attachment to and use with a crutch.

BACKGROUND OF THE INVENTION

Beverage holders for vehicles (e.g., cars, trucks, boats, etc.) are generally known. Such holders are generally constructed of a pivoting ring attached to a fixed bracket which is, in turn, affixed to the body of the vehicle. The pivoting ring allows the beverage container to be maintained in a generally upright orientation even though the vehicle may be subject to varying accelerations and inclinations.

Beverage holders are generally useful in providing a convenient receptacle for the beverage while the operator of the vehicle is otherwise occupied operating the vehicle. The holder is also useful in preventing upset of the beverage container during operation of the vehicle.

While beverage holders for vehicles have been generally well received, the benefits of their use has not been recognized by the physically handicapped. While it has been recognized that an operator of a vehicle may appreciate the convenience of the use of a beverage holder, such recognition has not been extended for the benefit of people afflicted with ambulatory difficulties (e.g., people on crutches).

Accordingly, it is an object of this invention to provide a beverage holder that is adapted to ambulatory aids (e.g., crutches).

It is a further object of the invention to provide a beverage holder which is adapted to fit the existing structure of the ambulatory aid.

SUMMARY OF THE INVENTION

A holder for a beverage container for use with a crutch having a pair of bowed sides connected by a bearing portion at their upper ends, a leg portion at their lower ends, a hand grip connected between the sides and a pair of aligned apertures therethrough on an axis generally parallel to the axis of the hand grip. The beverage holder, in combination with the beverage container, includes an abutting attachment member spanning the bowed sides parallel to the pair of aligned apertures and wrapping around and resiliently engaging the pair of apertures from opposing sides of the crutch. The beverage holder further includes a hoop extending from the attachment member in a horizontal plane defining a circular receptacle for the beverage container and a downwardly depending beverage container stop extending below the hoop for providing a positive stop for the supported beverage container within the hoop.

DETAILED DESCRIPTION OF A PREFERRED EMBODIMENT

Figure 1A:
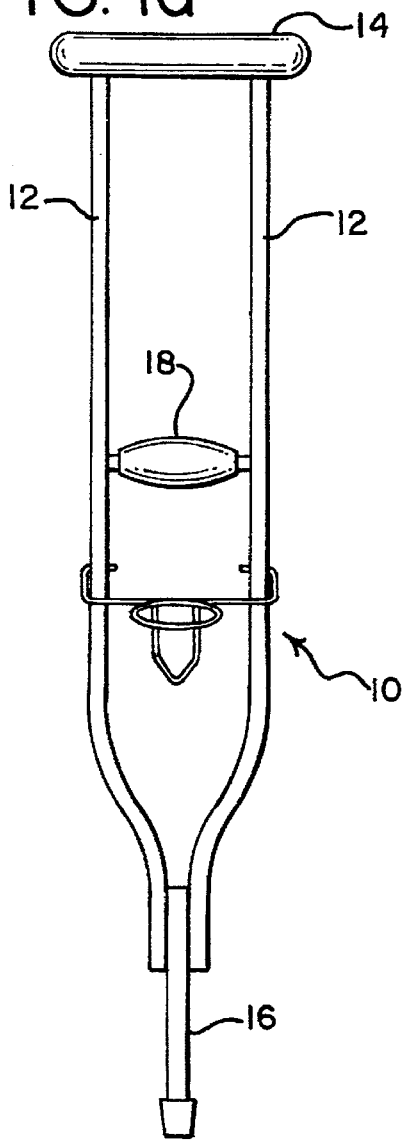
FIGS. 1*a* and 1*b* are a front and side view, respectively, of the beverage holder in accordance with an embodiment of the invention attached to a crutch.
Figure 1B:
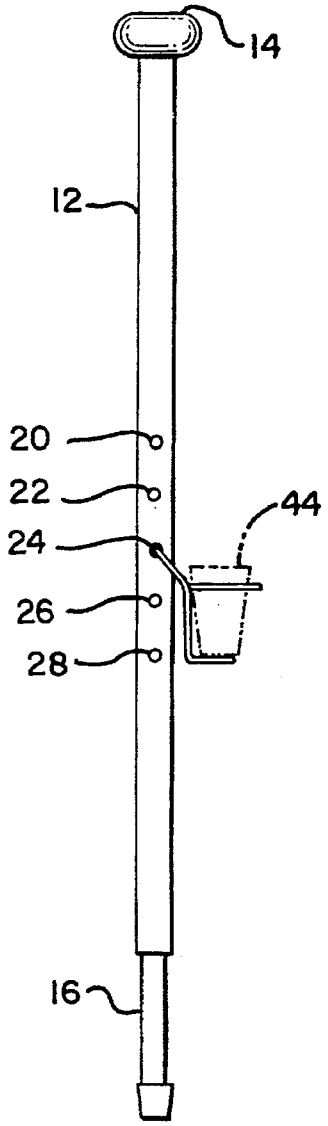

FIG. 1 shows a front and side view of a crutch and novel beverage holder 10. Shown in phantom (FIG. 1*b*) is a beverage container 44 supported by the beverage holder 10. As shown, the crutch is constructed with a pair of bowed sides 12 having a bearing portion 14 and a leg portion 16 at a second end. A hand grip 18 is located between the bowed sides and secured within a pair of vertically aligned holes 20. The crutch is constructed such that the hand grip 18 may be located in any of a number of locations along the length of the crutch within a corresponding set of holes 20, 22, 24, 26, 28.

Figure 2:
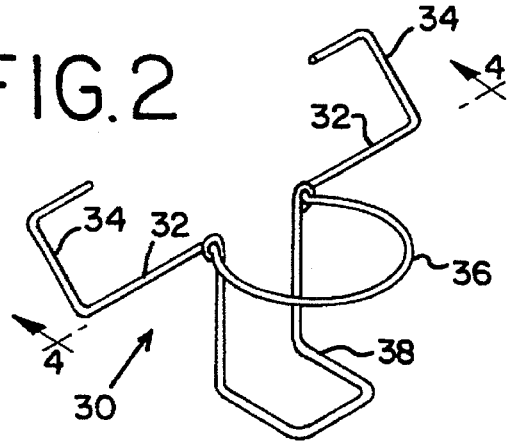
FIG. 2 is a front perspective view of the beverage holder of FIG. 1 under an alternate embodiment.
Figure 3:
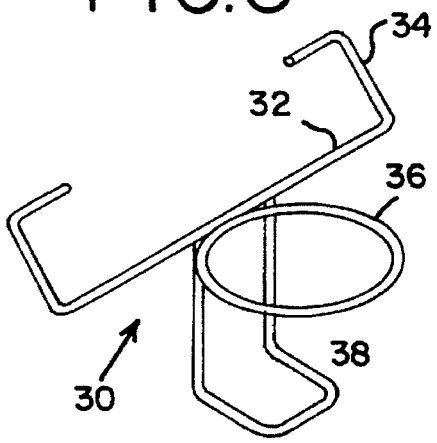
FIG. 3 is a front perspective view of the beverage holder of FIG. 1 under an alternate embodiment.

FIG. 2 is a front perspective view of the an alternative beverage holder 10. As shown the beverage holder 10 is constructed of an abutting attachment member 30, a hoop 36 and a downwardly depending beverage container stop 38. The abutting attachment member 30 is, in turn, made up of a generally straight center portion 32 and end portions 34. The end portions 34 may be fabricated of a generally semicircular or rectangular shape to wrap around opposing sides 12 of the crutch and engage a pair of aligned holes 20, 22, 24, 26, or 28 in the crutch for support. Upon engagement with the crutch, the straight portion 30 abuts against the bowed sides 12 in a transverse relationship during use thereby gaining torsional support for the cantilevered hoop 36 extending from the abutting attachment member 30.

The abutting attachment member 30 may be fabricated from a metal rod (e.g., #12 AWG steel wire) with end portions 34 formed on opposing ends. The hoop 36 and stop 38 (FIG. 2) may be secured to the abutting attachment member by any appropriate joining technology (e.g., welding, brazing, etc.).

Alternatively, in the preferred embodiment shown in FIG. 1, the hoop 36 may be fabricated from the center portion 32 of the abutting attachment member by bending the metal rod around a mandril to form a loop. Where opposing ends of the loop would otherwise meet, the rod may be bent back upon itself as shown in FIG. 2 to form the center portion 32 or the ends of the loop may be extended past one another to further improve the resiliency of attachment with the crutch. The end portions 34 may be created in the metal rod in a subsequent, or simultaneous, forming operation.

The hoop 36 may be sized to hold any number of beverage containers. Under one embodiment the hoop may be sized to hold a styrofoam cup or soft drink can (e.g., having a diameter of 2½–3").

Figure 4:
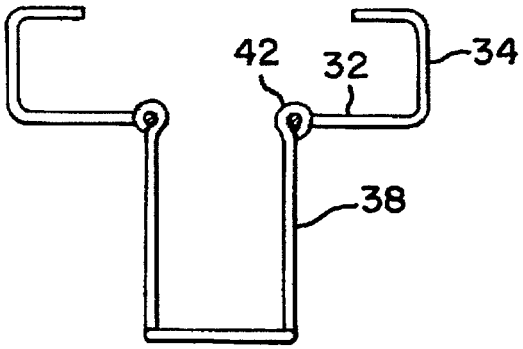
FIG. 4 is cut-away view showing mounting details of the beverage holder of FIG. 1.
Figure 5:
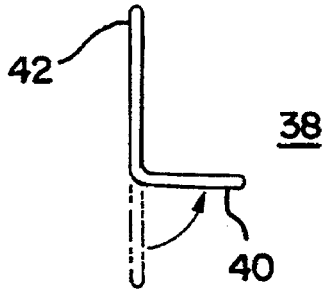
FIG. 5 is a partial side view of the beverage container stop of FIG. 1.

In a preferred embodiment, the downwardly depending beverage container stop may also be fabricated of metal rod (e.g., #12 AWG steel wire). The stop 38 may be fabricated by first bending a metal rod into a U-shape and then bending the joining portion 40 (FIG. 5) of the U-shape at right angles to the opposing ends 42 as shown in FIG. 5. The stop 38 may be secured to the abutting attachment member 30 by bending opposing ends 42 of the stop 38 around the attachment member 30 (see sectional view of FIG. 4) at the intersecting point of the hoop 36 and center portion 32. Joining the stop 38 to the attachment member 30 at the intersecting point provides torsional support for the stop and rigidly maintains the stop 38 below a center portion of the hoop 36.

In another embodiment of the invention, the beverage holder 10 may be fabricated of an appropriate plastic. Forming of the beverage holder 10 of plastic may be by injection molding or equivalent.

Figure 6A:
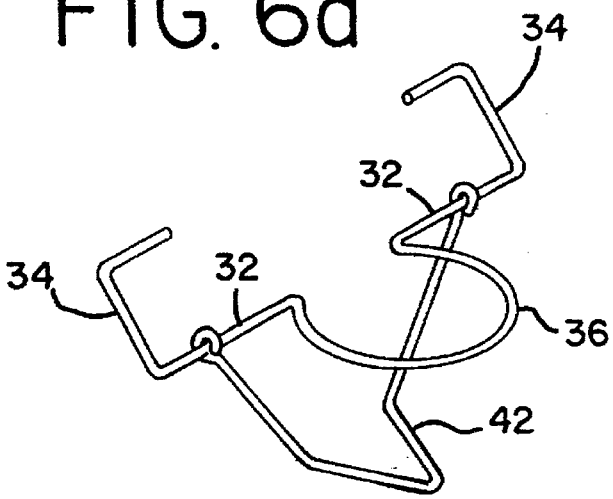
FIGS. 6*a* and 6*b* are a front and side view, respectively, of an alternate embodiment of the beverage holder of FIG. 1.
Figure 6B:
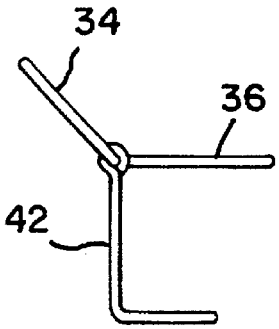

In another embodiment of the invention (FIG. 6), the downwardly depending stop 42 is attached to the center portion 32 proximate the intersection between the center portion 32 and end portions 34. Placing the attachment point of the stop 42 at the intersection of the center portion 32 and end portions 34 provides additional support for the stop portion 42 by allowing the stop 42 to also abut against the bowed sides 12, thereby gaining torsional support for the stop 42 in the support of the beverage container.

A specific embodiment of novel apparatus for supporting a crutch beverage holder according to the present invention has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention any and all modifications, variations, or equivalents that fall within the true spirit and scope of the basic underlying principles disclosed and claimed herein.

I claim:

1. A holder for a beverage container for use with a crutch having a pair of bowed sides connected by a bearing portion at their upper ends, a leg portion at their lower ends, a hand grip connected between the sides and a pair of aligned apertures therethrough on an axis generally parallel to the axis of the hand grip, the beverage holder comprising, in combination with the beverage container:

an abutting attachment member spanning the bowed sides parallel to the pair of aligned apertures and wrapping around and adapted to resiliently engage the pair of apertures, respectively, from opposing sides of the crutch;

a hoop extending from the attachment member in a horizontal plane defining a circular receptacle for the beverage container;

a downwardly depending beverage container stop extending from and below the hoop for providing a positive stop for supporting the beverage container within the hoop.

2. The beverage holder as in claim 1 wherein opposing ends of the abutting attachment member wrapping around opposing sides of the crutch further comprise a formed metal rod having a generally semicircular shape.

3. The beverage holder as in claim 2 wherein the abutting attachment member further comprises a metal rod forming a relatively straight center portion joining the end portions.

4. The beverage holder as in claim 3 wherein a portion of the relatively straight center portion is formed into the hoop.

5. The beverage holder as in claim 1 wherein the downwardly depending beverage container stop further comprises a support member generally parallel to the pair of bowed sides of the crutch, secured to the abutting attachment member at a first end and having a stop member at a second end orthogonal to the support member.

* * * * *